US006439429B1

(12) United States Patent
Gross

(10) Patent No.: US 6,439,429 B1
(45) Date of Patent: Aug. 27, 2002

(54) TAMPER-EVIDENT CLOSURE AND SPOUT FITMENT FOR A POUCH

(75) Inventor: Richard A. Gross, Oconomowoc, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/899,771

(22) Filed: Jul. 5, 2001

(51) Int. Cl.[7] ..... B65D 35/00
(52) U.S. Cl. ..... 222/92; 222/153.02
(58) Field of Search ..... 222/92, 107, 153.06, 222/153.07, 568

(56) References Cited

U.S. PATENT DOCUMENTS

| | | | | |
|---|---|---|---|---|
| 3,690,524 A | | 9/1972 | Haberhauer | |
| 4,732,299 A | | 3/1988 | Hoyt | |
| 5,058,775 A | * | 10/1991 | Gross et al. | 222/153.07 |
| 5,088,613 A | * | 2/1992 | Dutt et al. | 222/153.07 |
| 5,823,383 A | | 10/1998 | Hins | |
| 5,873,491 A | | 2/1999 | Garcia et al. | |
| 5,919,360 A | | 7/1999 | Contaxis, III et al. | |
| 5,971,613 A | | 10/1999 | Bell | |
| 6,000,848 A | | 12/1999 | Massioui | |
| 6,050,451 A | | 4/2000 | Hess, III et al. | |
| 6,073,809 A | * | 6/2000 | Long, Jr. | 222/153.07 |
| 6,116,441 A | * | 9/2000 | Decelles et al. | 222/153.07 |
| 6,131,806 A | | 10/2000 | Hess, III et al. | |
| 6,138,849 A | | 10/2000 | Roemer et al. | |
| 6,142,341 A | | 11/2000 | Uematsu | |
| 6,158,622 A | | 12/2000 | Igarashi | |
| 6,273,307 B1 | * | 8/2001 | Gross et al. | 222/92 |

FOREIGN PATENT DOCUMENTS

| | | |
|---|---|---|
| CH | 677 093 A5 | 4/1991 |
| DE | 297 06 158 U1 | 8/1987 |
| WO | WO 00/06464 A1 | 2/2000 |

OTHER PUBLICATIONS

U. S. patent application Ser. No. 09/640, 614, filed Aug. 17, 2000.

Brochure entitled Standard Range of Pouch Fitments, Menshen Packaging U.S.A. and Waldwick Plastics Coporation (4 xerographic pages from a brochure).

Color copies of 6 pages of a brochure entitled "IPN A Closure Solution For Every Application".

* cited by examiner

*Primary Examiner*—Joseph A. Kaufman
(74) *Attorney, Agent, or Firm*—Wood, Phillips, Katz, Clark & Mortimer

(57) ABSTRACT

A tamper-evident dispensing structure is provided for being sealed to a collapsible pouch. The structure includes a fitment and a lid structure which are each separately molded and which can be subsequently non-releasably attached. The fitment is adapted to be sealed to a periphery of the pouch at an opening in the pouch. The fitment has a receiver and has at least one dispensing flow passage through the fitment. The lid structure includes (1) a base for being fixedly and non-releasably attached to the fitment receiver, (2) a cap for being sealingly and removably mounted on the fitment to occlude the dispensing passage, and (3) at least a first frangible web connecting the cap to the base for accommodating separation of the cap from the base.

19 Claims, 16 Drawing Sheets

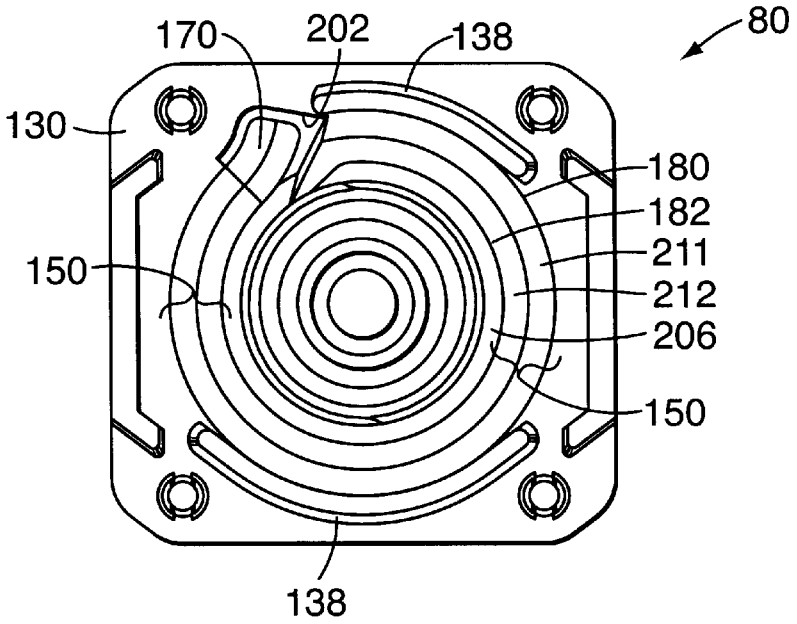
FIG. 11
FIG. 12
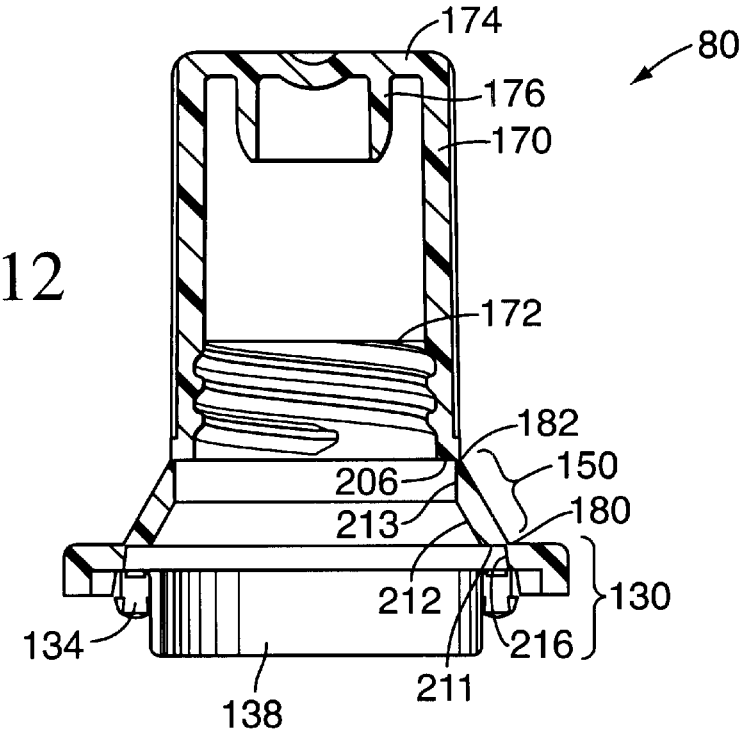

FIG. 13
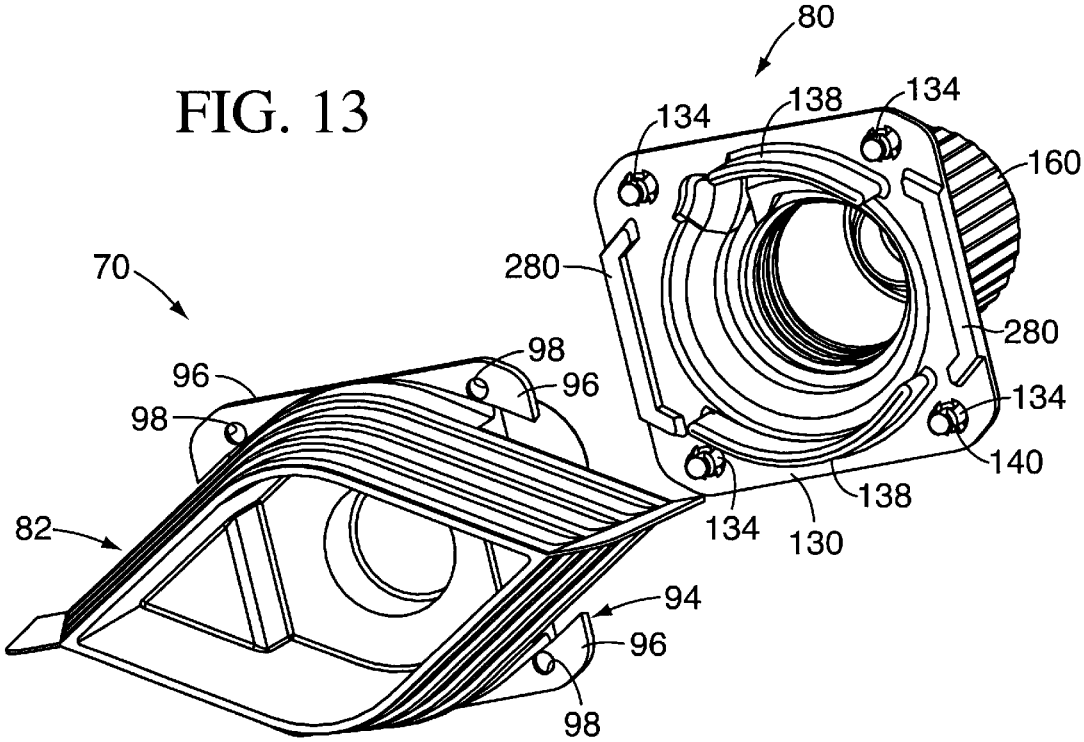
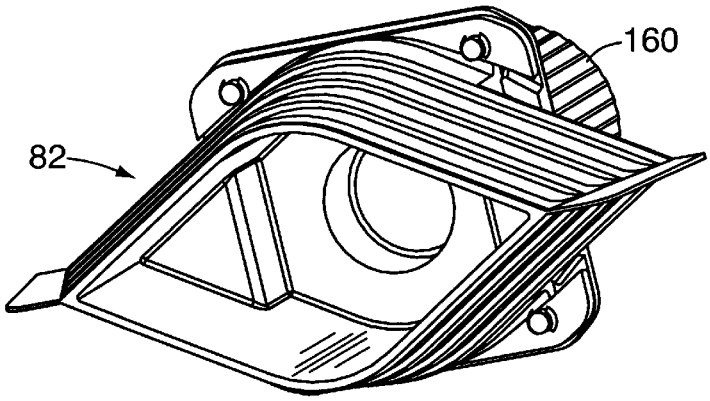
FIG. 14

FIG. 15
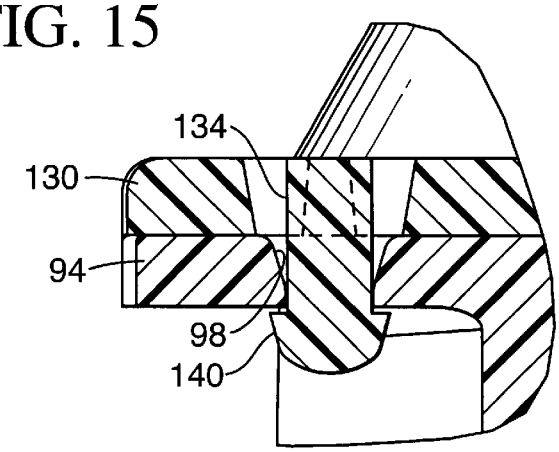
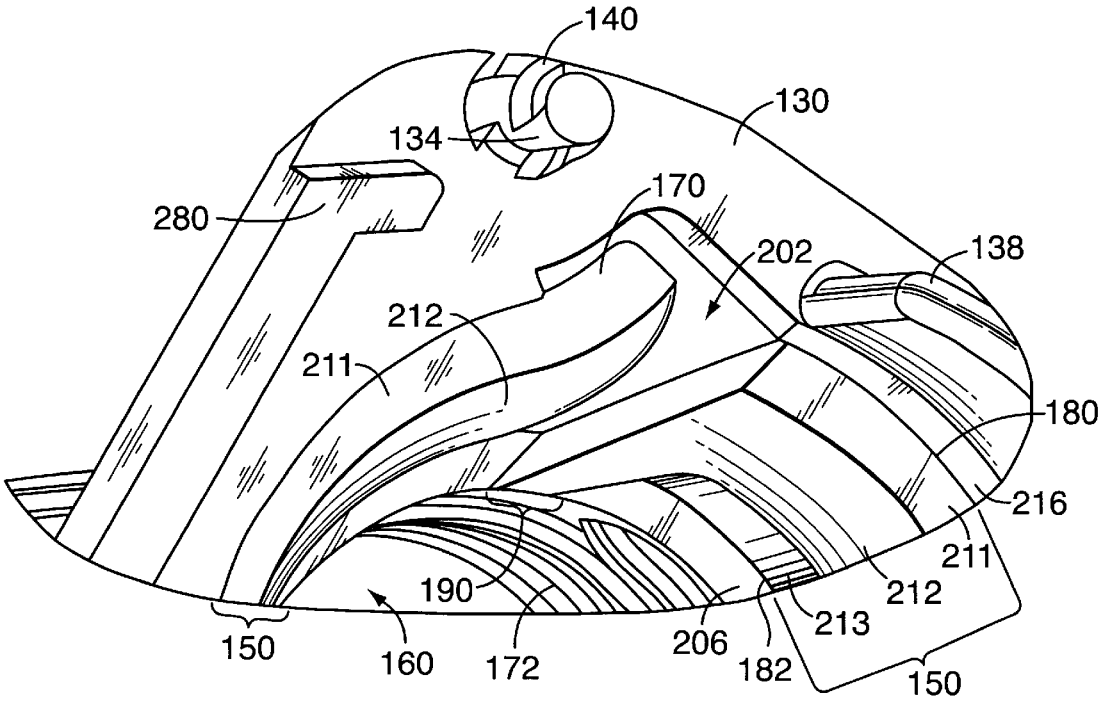
FIG. 16

TAMPER-EVIDENT CLOSURE AND SPOUT FITMENT FOR A POUCH

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a two-component, tamper-evident dispensing structure for a collapsible pouch that contains a fluent product.

BACKGROUND OF THE INVENTION AND TECHNICAL PROBLEMS POSED BY THE PRIOR ART

Collapsible pouches are typically used for packaging a wide variety of products involving food, beverages, personal care, household care, or other similar or dissimilar products which may be in the form of a liquid, lotion, gel, paste, or the like. Such a pouch is typically made from a flexible, heat-sealable, polymeric sheet or from a flexible, paperboard or metal foil sheet having a heat-sealable, polymeric lining. The pouch typically has two, opposed, flexible web portions peripherally sealed to one another so as to define an interior region, which is adapted to contain such a product, and so as to define an opening for establishing communication between the pouch interior region and the exterior of the pouch. The opening is adapted to receive a dispensing fitment, which may incorporate a dispensing valve, and a removable cover, or other similar or dissimilar features, and which is molded from a polymeric material that can be heat-sealed to the web portions of the collapsible pouch.

An example of such a fitment, which incorporates a dispensing valve and a removable cover, is disclosed in U.S. Pat. No. 6,050,451, which is assigned to AptarGroup, Inc. of Crystal Lake, Ill. As disclosed therein, a base of the fitment has two side walls, which converge at two opposed ends of the fitment and which are oriented vertically when the fitment is oriented vertically. Moreover, each side wall has a series of spaced ribs, which project from each sidewall and to which an associated one of the web portions of a collapsible pouch can be heat-sealed.

Although the above-described prior art structure functions well in the applications for which it is designed, it would be desirable to provide an improved dispensing structure which could provide additional benefits to the manufacturer as well as the consumer.

For example, it would be beneficial to provide an improved dispensing structure for a pouch wherein the dispensing structure can include a very easily opened, yet highly visible, tamper-evident feature.

It would also be beneficial if such an improved structure could accommodate the use of means for supporting the pouch as necessary to effect filling of the pouch with product prior to the pouch or fitment being sealed closed.

It would be advantageous if such an improved dispensing structure could accommodate molding of the structure by means of a simple, straight-pulled molding action in order to maximize the number of cavities in the mold assembly and in order to minimize cost.

Further, it would be desirable if such a dispensing structure, when provided with a tamper-evident feature, could function in a way that would eliminate, or at least substantially minimize, the creation of a waste piece requiring disposal after initially opening the dispensing structure.

Also, it would be beneficial if such an improved, tamper-evident dispensing structure, after being opened, would not have any piece loosely retained on the fitment in a way that would permit such a piece to flop around or jiggle loosely when the opened pouch is being used for dispensing product or when the opened pouch is otherwise being handled.

It would also be desirable to provide such an improved dispensing structure which, once opened, would provide only a minimal obstruction, or no obstruction, in the product dispensing area so as to avoid any significant interference with product flow, or with insertion of the dispensing structure into a receiving vessel or even into a user's mouth.

Additionally, it would be beneficial if such an improved structure could be designed to readily accommodate reinstallation of a closure member, such as a cap, so as to allow sealing the system to be closed between multiple uses.

It would also be advantageous if such an improved dispensing structure could accommodate the optional use of an external or internal dispensing valve for controlled dispensing of product with a reduced likelihood of product spillage.

It would also be desirable to provide such an improved dispensing structure that would simplify the system for filling a pouch with product. For example, it would be beneficial if such an improved dispensing structure could permit the filling of a pouch through at least part of the dispensing structure in a stable manner on a manufacturing line and in a way that would subsequently readily accommodate closure of the dispensing structure.

The present invention permits the incorporation of design elements that would provide the above-discussed advantages, benefits, and features.

SUMMARY OF THE INVENTION

The present invention provides a tamper-evident dispensing structure for being sealed to a collapsible pouch. The pouch has two opposed, flexible web portions which are sealed to one another so as to define an interior region and so as to define an opening to the interior region. The opening is adapted to receive a portion of the dispensing structure when the dispensing structure is sealed to the collapsible pouch.

The dispensing structure of the present invention enables the manufacturer to fill a pouch with product and install the dispensing structure in the pouch in a number of optional ways.

In a preferred form, an empty pouch is initially sealed all the way around the periphery except for the opening into which a first part of the dispensing structure is disposed and sealingly attached. The attached first part of the dispensing structure includes a passage for accommodating flow of fluent material into or out of the pouch. The pouch can be filled with the product through the installed first part of the dispensing structure in the top of the pouch. Subsequently, a second part of the dispensing structure can be attached to the first part of the dispensing structure for creating a sealed closure. In a most preferred form of the invention, the first part of the dispensing structure is a fitment that includes a flow passage and that includes a plurality of support tabs which can support the fitment, with the pouch sealingly attached thereto, on rails for being conveyed through a suitable filling apparatus for filling the pouch with liquid product through the fitment. A second part of the dispensing structure, such as a lid structure, can be subsequently installed on the fitment to form a closed package.

In a second alternative, but one that is more complicated, the empty pouch could be first filled with fluent product, prior to installing the dispensing structure fitment and lid structure on the pouch. The dispensing structure fitment and lid structure could be provided as a already assembled, integral, closed dispensing structure for being heat-sealed to the top of an open pouch after the pouch has been filled with product through the opening in the top of the pouch.

A third alternative can be accommodated by the dispensing structure of the present invention. Specifically, the dispensing structure, including the fitment and an attached, closed lid structure, could be initially sealed to the opening in the pouch, but the opposite, bottom end of the pouch could be left open. Then the pouch could be inverted, and the pouch could be filled with product through the open end. Subsequently, the open end of the pouch could be sealed closed.

The present invention contemplates, however, that most product packaging users will want to take advantage of the ease and efficiency inherent in the present invention by using it in the following process: (1) providing an empty pouch which is initially sealed all around the periphery except at an opening at the top of the pouch, (2) heat-sealing the first part, or fitment, of the dispensing structure to the pouch at the opening, (3) filling the pouch with product through a dispensing passage in the fitment while the pouch and fitment are suspended from support tabs on the fitment, and (4) lastly, installing the lid structure on the fitment to form a sealed closure for the package.

According to a preferred aspect of the invention, the fitment has at least one surface for being sealed to the pouch around the periphery of the fitment at the pouch opening. The fitment also has a receiver for the lid structure and at least one dispensing passage through the fitment.

The lid structure is molded separately from, and can be subsequently mounted to, the fitment. The lid structure has a base for being fixedly and non-releasably attached to the fitment receiver. The lid structure also has a cap for being sealingly and removably mounted on the fitment to occlude the dispensing passage. The lid structure also has at least a first frangible web connecting the cap to the base for accommodating subsequent separation of the cap from the base.

In a presently preferred embodiment, the fitment has a body and a spout extending above the body and receiver for being closed by the cap. The dispensing passage extends through the body, receiver, and spout.

In a preferred form of the invention, the lid structure base and the fitment receiver are adapted to be snap-fit together.

In a presently preferred form of the invention, the lid structure further includes (1) a tear band that (a) is located between the cap and the base, and (b) is defined along one edge by the first frangible web; and (2) a second frangible web connecting only part of the tear band to the cap to leave the tear band attached to the cap after tearing the first and second frangible webs. This eliminates the creation of a separate tear-off waste piece requiring disposal.

Preferably, the tear band has a generally frustoconical configuration wherein the first and second frangible webs are each defined by a reduced thickness section of material. The tear band preferably includes a grippable tab and an opposite end portion merging with the cap, and the second frangible web extends from the grippable tab to the opposite end portion.

The cap may be sealingly disposed on the fitment by a suitable means, including friction sealing surfaces or sealing beads in conjunction with retention features such as threads or snap-fit bead and groove arrangements, and the like.

Preferably, the fitment receiver includes a platform extending over the fitment body, and the platform defines at least one aperture extending through the platform. The preferred form of the lid structure base includes (1) a post, and (2) an enlarged head that (a) is located at the distal end of the post, and (b) is wider than the aperture so that the head can be forced through the platform aperture owing to temporary elastic deformation of either the head or platform. Thus, the post can be received in the aperture with the head located adjacent the platform to retain the fitment and lid structure in a non-removable, snap-fit engagement.

In an alternate embodiment, a dispensing valve, such as a flexible, slit-type, pressure-openable valve, may be mounted within the dispensing passage of the fitment.

Numerous other objects, features, and advantages of this invention will become readily apparent from the following detailed description, from the claims, and from the accompanying drawings.

BRIEF DESCRIPTION OF THE DRAWINGS

In the accompanying drawings, in which like numerals are employed to designate like parts throughout:

FIG. 4 illustrates the fitment component and lid structure component prior to assembly of those two components to form the dispensing structure;

FIG. 11 is a bottom plan view taken generally along the plane 11—11 in FIG. 10;

FIG. 12 is a cross-sectional view taken generally along the plane 12—12 in FIG. 9;

FIG. 13 is an exploded, bottom perspective view of the dispensing structure components prior to assembling the lid structure and the fitment;

FIG. 14 is a bottom perspective view of the dispensing structure after the lid structure and fitment have been assembled;

FIG. 15 is an enlarged, fragmentary, cross-sectional view taken generally along the plane 15—15 in FIG. 3;

FIG. 16 is a greatly enlarged, fragmentary, bottom perspective view of a portion of the lid structure;

DETAILED DESCRIPTION OF THE ILLUSTRATED EMBODIMENTS

While this invention is susceptible of being embodied in many different forms, this specification and the accompanying drawings disclose only some specific embodiments, as examples of fitments embodying this invention. However, this invention is not intended to be limited to the embodiments so disclosed. The scope of this invention is pointed out in the appended claims.

To facilitate their description, the disclosed embodiments are illustrated and described in selected orientations. It will be understood, however, that a dispensing structure embodying this invention may be manufactured, stored, transported, used, and sold in orientations other than the orientations disclosed.

Figure 1:
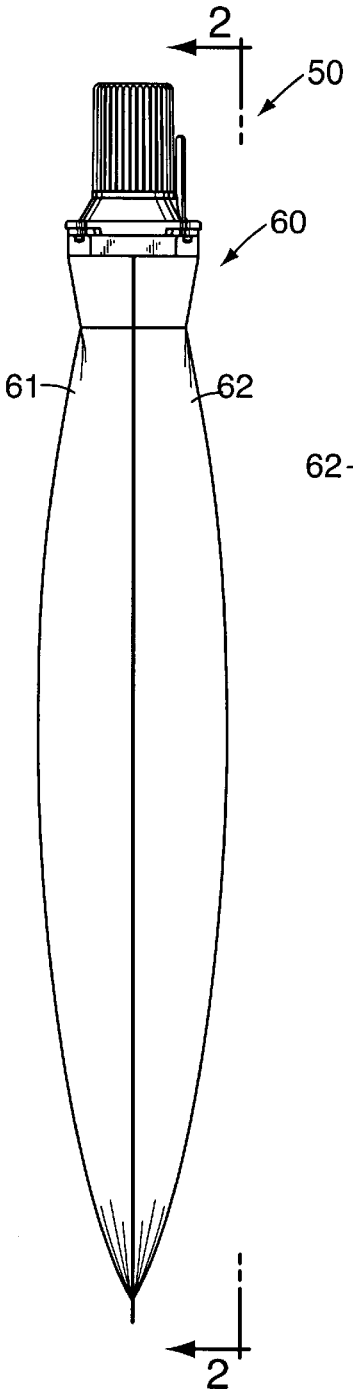
FIG. 1 is a side elevational view of a dispensing structure of the present invention as shown installed in a collapsible pouch.
Figure 2:
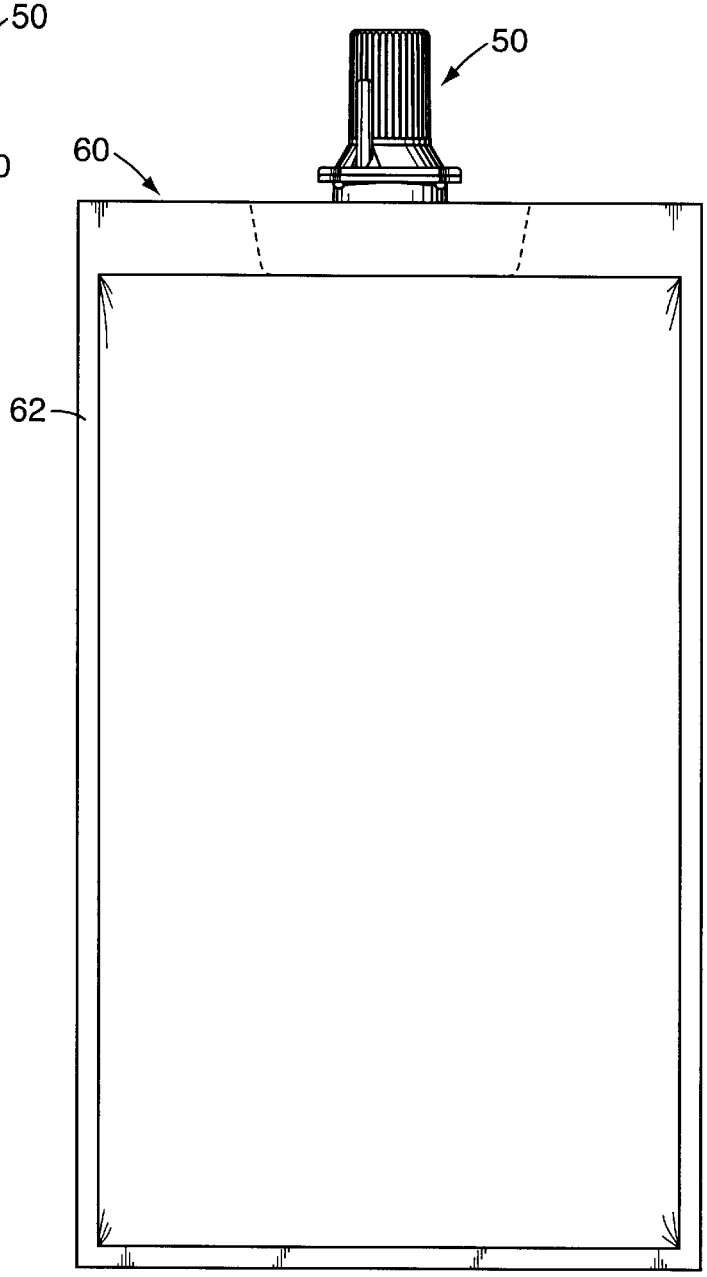
FIG. 2 is a front elevational view taken generally along the plane 2—2 in FIG. 1.

FIGS. 1 and 2 illustrate a dispensing structure of the present invention designated generally by the reference number 50 shown installed on a collapsible pouch 60. The pouch 60 contains a fluent product which is to be dispensed after opening the dispensing structure 50, and such a product may be a food, beverage, personal care product, household product, or other similar or dissimilar product in the form of a liquid, suspension, paste, gel, powder, particles, etc.

The collapsible pouch 60, which can be of special or conventional design, is typically and preferably made from a flexible, heat-sealable, polymeric sheet or from a flexible, paperboard or metal foil sheet having a heat-sealable, polymeric lining so as to have two opposed, flexible web portions 61, 62, as shown in FIG. 1. The web portions 61, 62 are sealed to one another at the peripheral edges so as to define an interior region, and so as to define an opening which (1) opens to the interior region, and (2) is adapted to receive a lower portion of the dispensing structure 50 when the dispensing structure 50 is sealed to the collapsible pouch 60.

Figure 4:
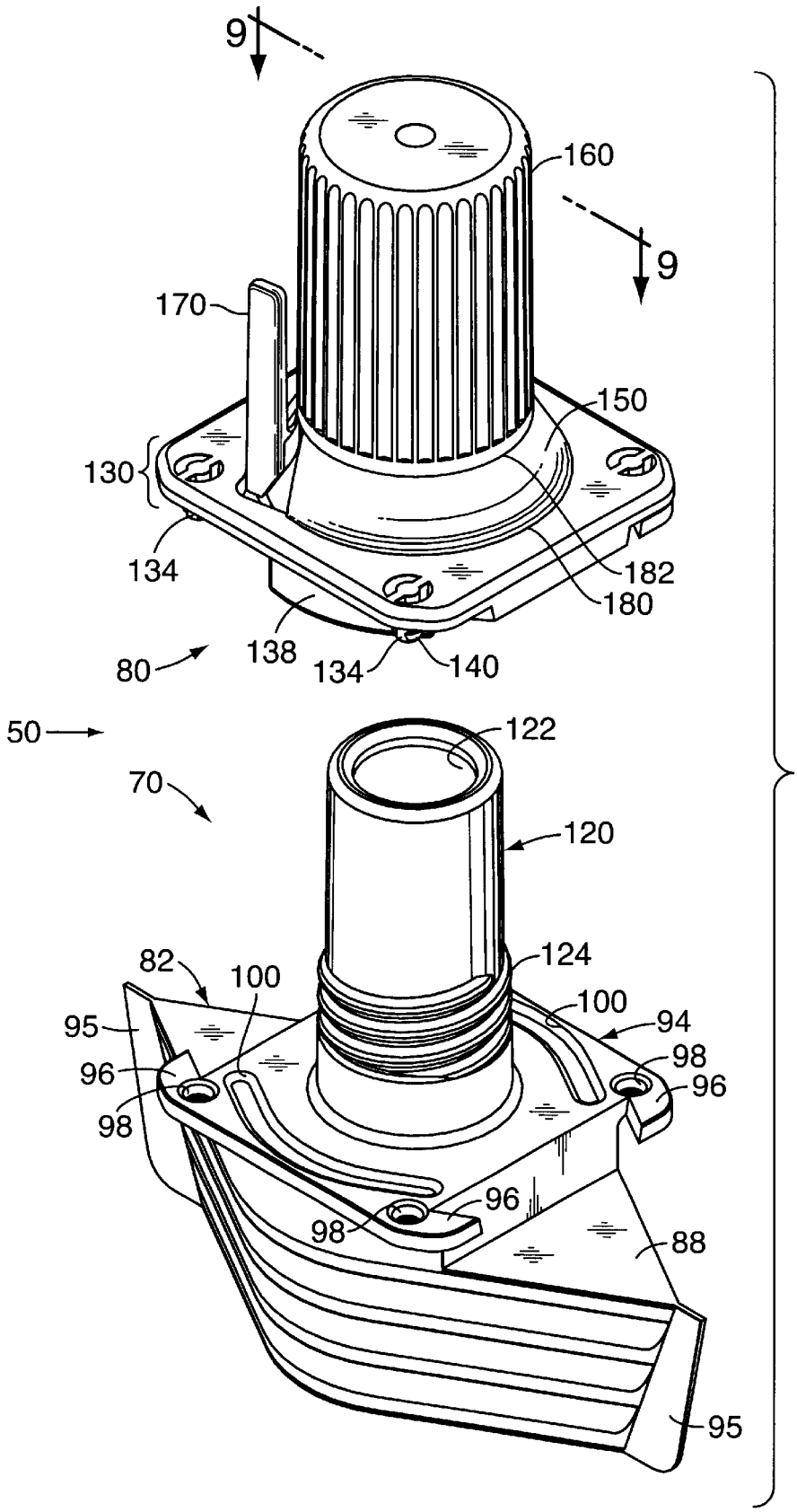
FIG. 4 is an exploded perspective view of the dispensing structure shown in FIG. 3.

As can be seen in FIG. 4, the present invention dispensing structure 50 includes two basic elements, parts, or components which are each preferably separately molded and subsequently attached or connected together—a fitment 70 and a lid structure 80.

In a presently preferred form, at least the fitment 70 is molded from a polymeric material, high density polyethylene (HDPE) being preferred, which is suitable to be sealed to the web portions 61, 62 of the collapsible pouch 60 by ultrasonic bonding, which is preferred, or by adhesive securement, or otherwise.

Figure 8:
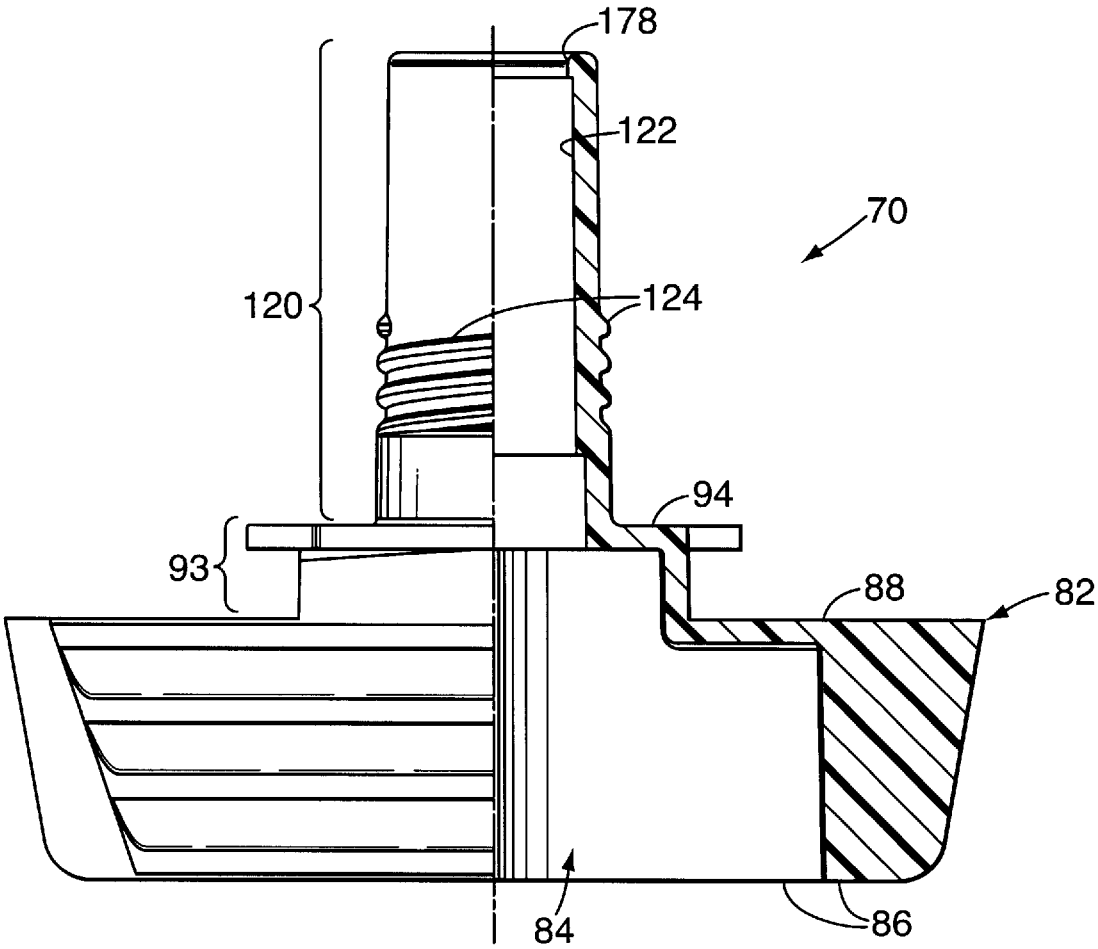
FIG. 8 is a combined, partial cross-sectional, view and side elevational view of the dispensing structure fitment shown in FIG. 4.

As can be seen in FIG. 8, the fitment 70 includes a body 82 with an internal dispensing passage 84 for extending through the body 82 and establishing communication between the interior of the pouch and the exterior of the pouch when the lid structure 80 is opened. The fitment body 82 may have any suitable special or conventional design for fitting within the pouch opening and for being sealed to the pouch web portions 61, 62. One such fitment body design that may be employed in the dispensing structure of the present invention is disclosed in FIGS. 9–13 of the pending U.S. patent application Ser. No. 09/640,614 filed on Aug. 17, 2000, and the disclosures of that patent application are incorporated herein by reference thereto to the extent not inconsistent herewith. Basically, such a fitment body has a generally boat-shaped configuration defining exterior surfaces for being sealingly secured by ultrasonic thermal bonding, or otherwise, to the flexible margins of the pouch film walls or webs. Other than the fact that the fitment body should have suitable sealing surfaces and a dispensing passage, the particular detailed design of the fitment body forms no part of the present invention.

Figure 6:
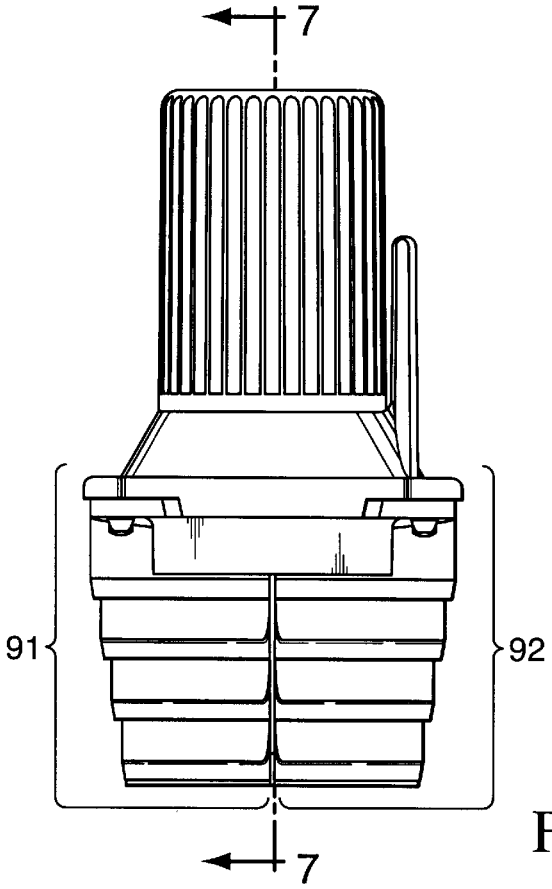
FIG. 6 is an end elevational view taken generally along the plane 6—6 in FIG. 5.

In a presently preferred form as shown in FIG. 8, the fitment body 82 is molded so as to have a hollow, boat-shaped configuration with an open bottom 86, a top deck 88, and two opposite, side wall portions 91, 92 (FIG. 6). In a preferred embodiment as shown in FIG. 4, a fin 95 projects from each opposite end edge of the fitment 70. In a preferred form of the fitment, the peripheral dimensions increase from a smallest dimension at the bottom, through intermediate dimensions between the bottom and top, which do not decrease after increasing, to a largest dimension at the top.

As shown in FIG. 8, a hollow receiver 93 projects up from the deck 88 and has a platform 94 with four wings or tabs 96 (FIG. 4). As can be seen in FIG. 13, the tabs 96 preferably do not overlie any part of the body 82. As shown in FIGS. 4 and 13, each tab 96 defines an aperture 98. As shown in FIG. 4, the platform 94 also defines two arcuate grooves 100.

As seen in FIG. 8, a spout 120 extends above the body 82 and receiver 93. A dispensing passage 122 extends through the spout 120, and communicates at the bottom of the spout 120 with the interior hollow region of the receiver 93 and body 82. The spout passage 122 may be regarded as a continuation, or part, of the body dispensing passage 84 (FIG. 8). The entire fitment 70 may thus be characterized as including a dispensing passage 84, 122 that extends completely through the fitment from bottom to top.

The spout 120, in the preferred embodiment, includes an exterior male thread 124 as shown in FIG. 8. In a preferred method of manufacture, the fitment 70 is molded from thermoplastic material, and the spout thread 124 is released from the adjacent, mating mold part by unscrewing the fitment 70 from the mold part. In another method of manufacture, the fitment 70 is not unscrewed from the adjacent mold part. Rather, the fitment 70 and mold are merely pulled apart, and, to that end, the male thread 124 is preferably sufficiently shallow, and the spout wall thickness is sufficiently thin and flexible, so that separation of the fitment from the mold does not require a side action mold assembly to release the threads. Thus, given the above-described shape of the fitment body 82, and given the fact that the tabs 96 do not directly overlie the body 82, the fitment 70 can be molded in a simple, two-part mold that defines a horizontal parting interface and that can be opened by simple, uniaxial, straight-pull movements of the mold parts relative to one another, along a line of action perpendicular to the parting interface, and without any side-action mold action.

In an alternate embodiment (not illustrated), the fitment 70 can be provided with an internal, slit-type, pressure-openable, flexible valve (not illustrated), which is mounted within or below the spout 120 of the fitment 70. The valve may be identical, or similar structurally and functionally, to valves disclosed in U.S. Pat. No. 5,839,614, the disclosures of which are incorporated herein to the extent pertinent hereto and to the extent not inconsistent herewith.

Figure 3:
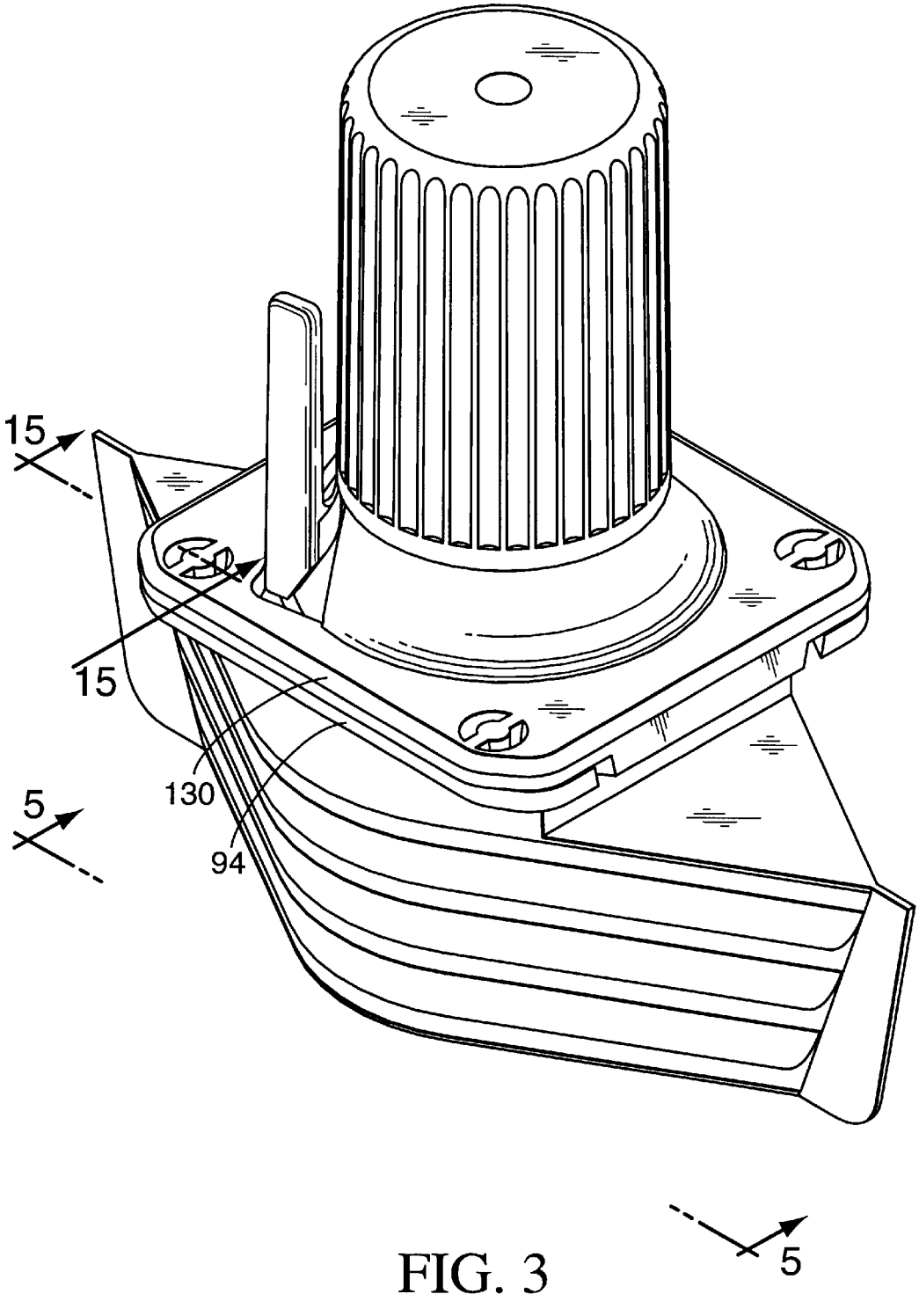
FIG. 3 is a top, perspective view of the dispensing structure of the present invention prior to installation in the pouch illustrated in FIGS. 1 and 2.
Figure 5:
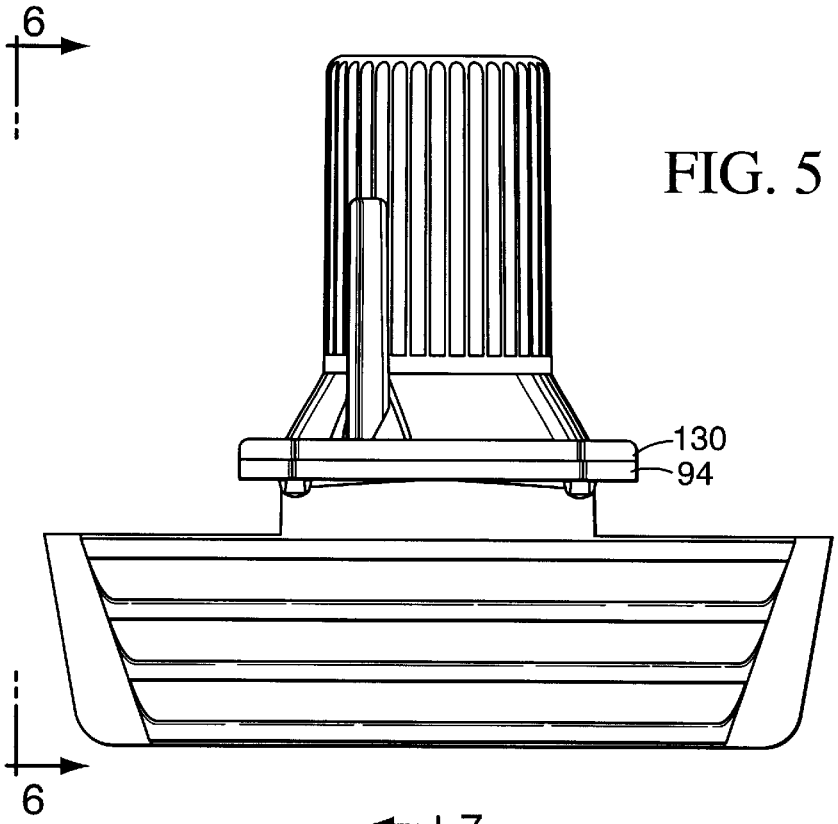
FIG. 5 is a side elevational view of the dispensing structure taken generally along the plane 5—5 in FIG. 3.
Figure 9:
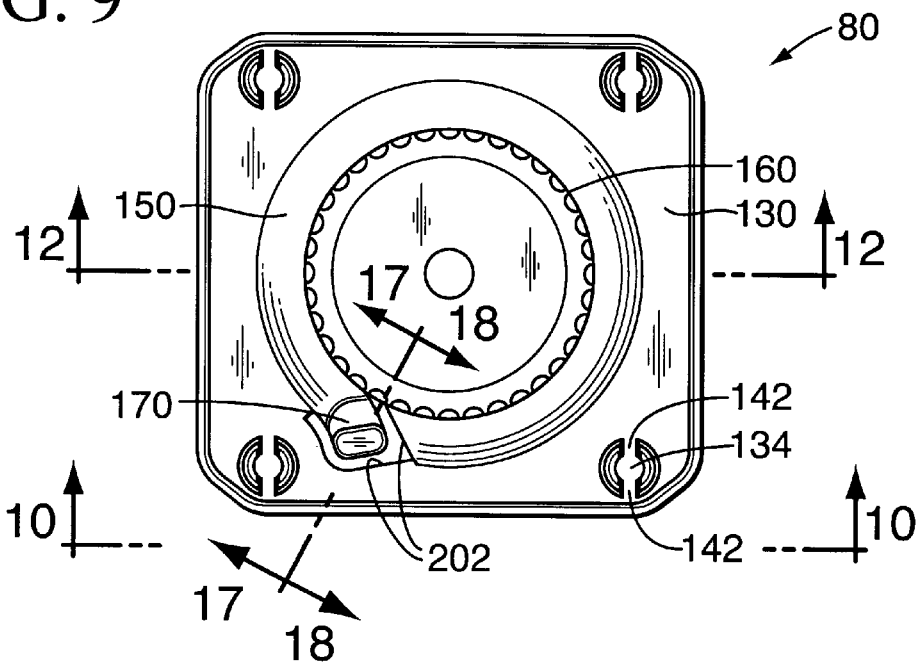
FIG. 9 is a top plan view of the lid structure taken generally along the plane 9—9 in FIG. 4.
Figure 10:
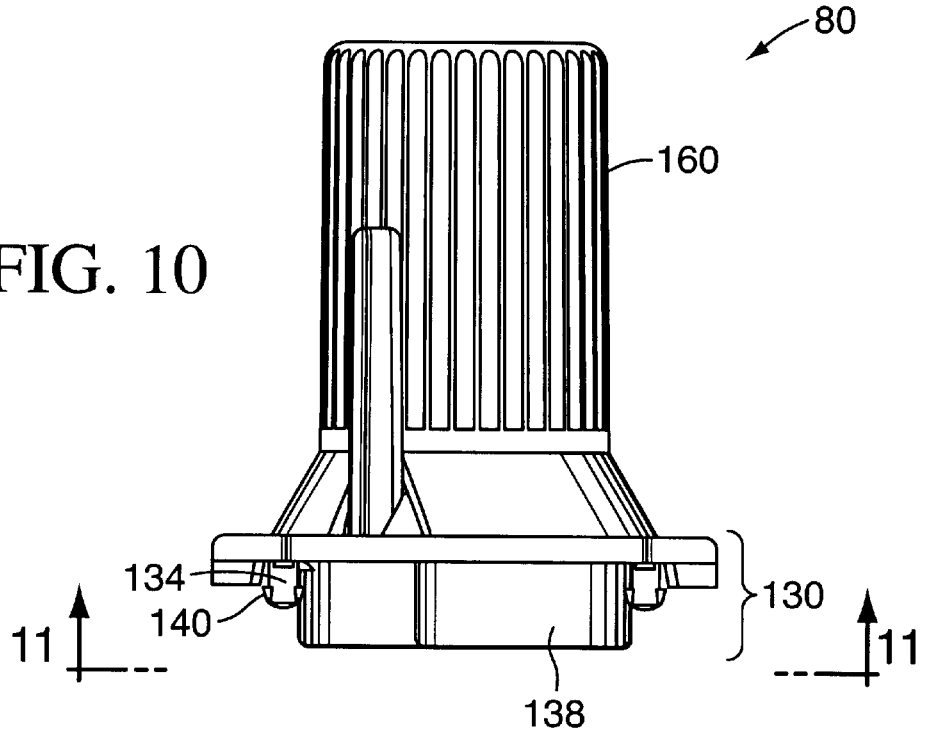
FIG. 10 is a side elevational view taken generally along the plane 10—10 in FIG. 9.
Figure 17:
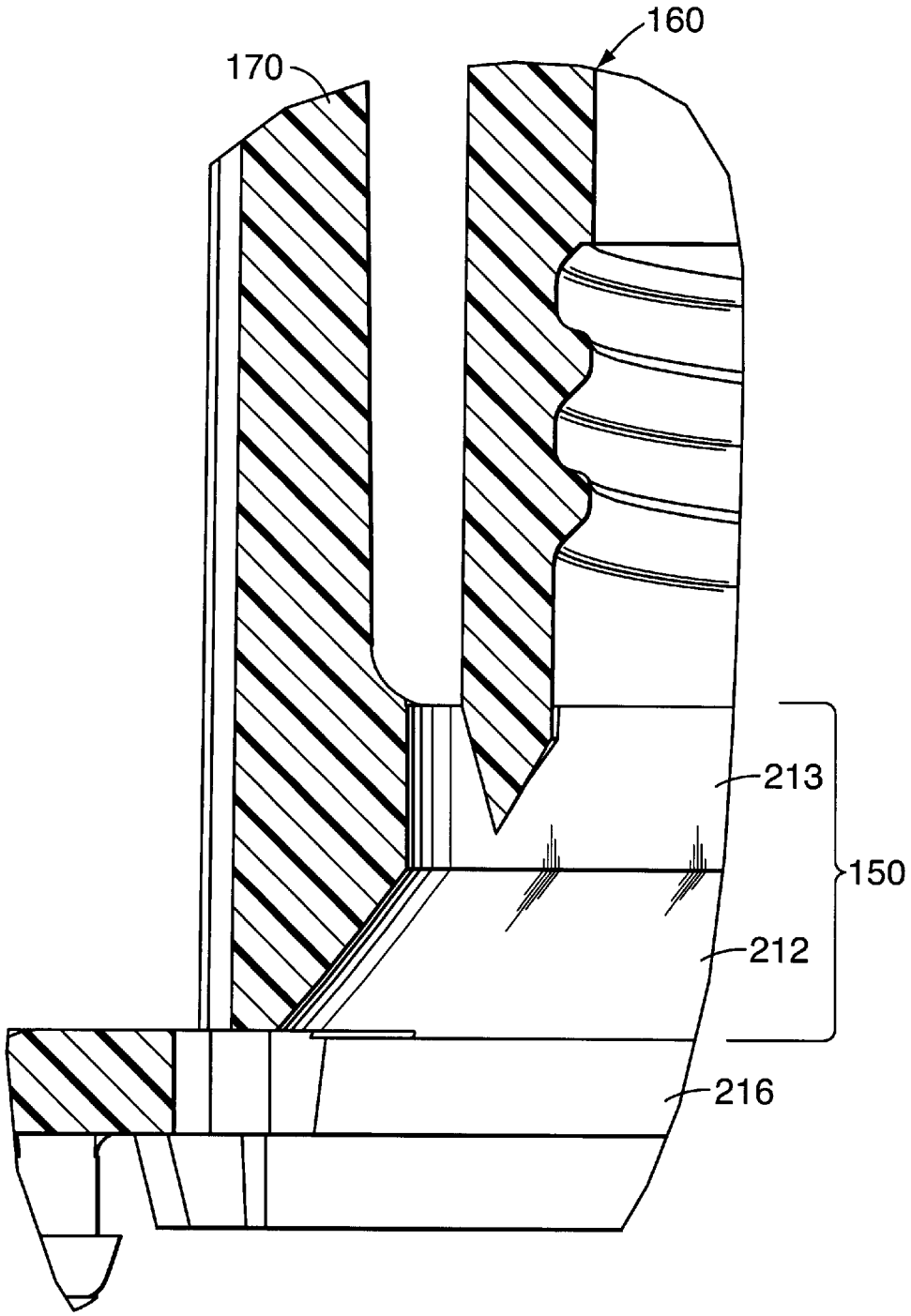
FIG. 17 is a greatly enlarged, fragmentary, cross-sectional view taken generally along the plane 17—17 in FIG. 9.
Figure 18:
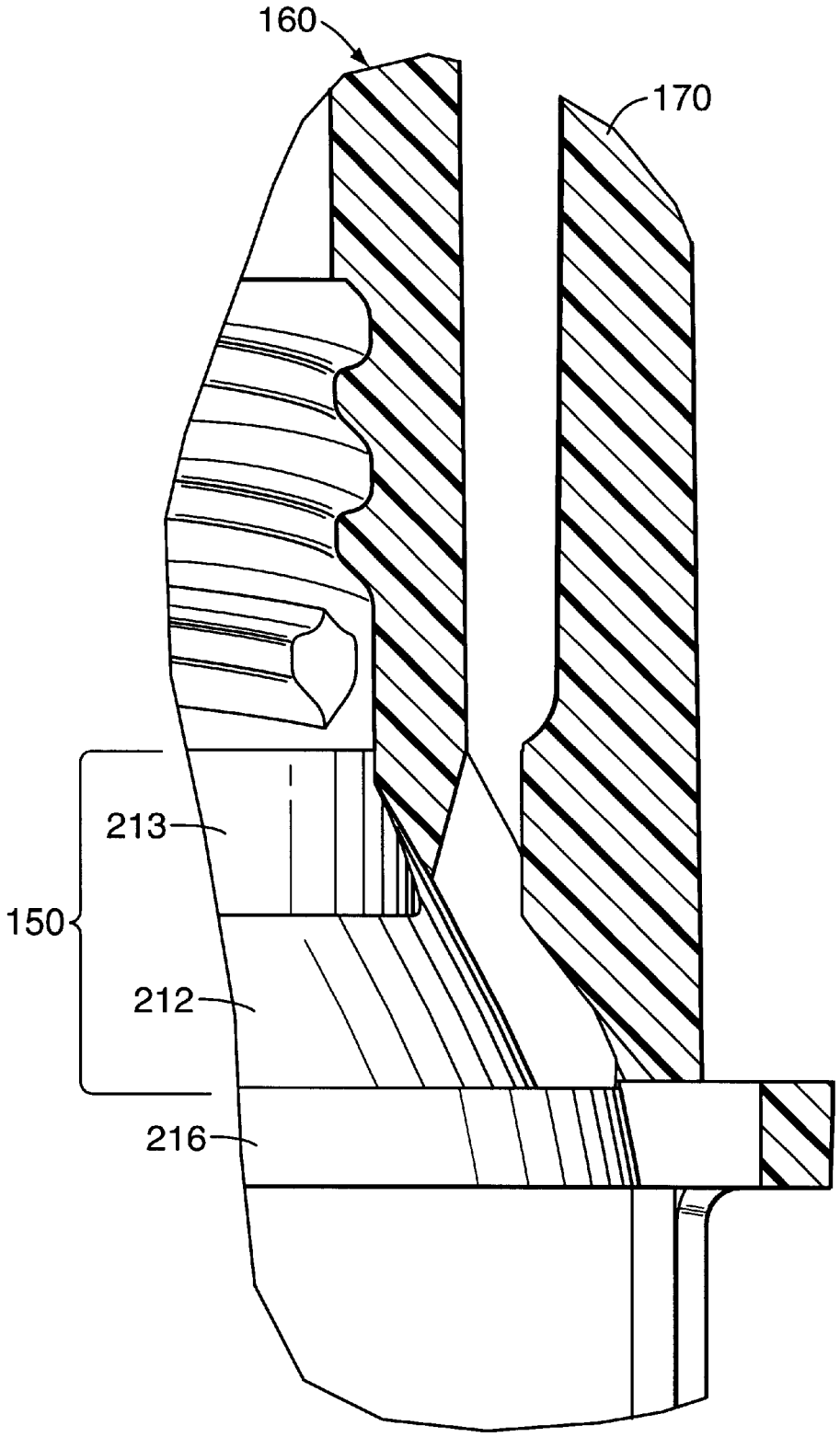
FIG. 18 is a greatly enlarged, fragmentary, cross-sectional view taken generally along the plane 18—18 in FIG. 9.
Figure 20:
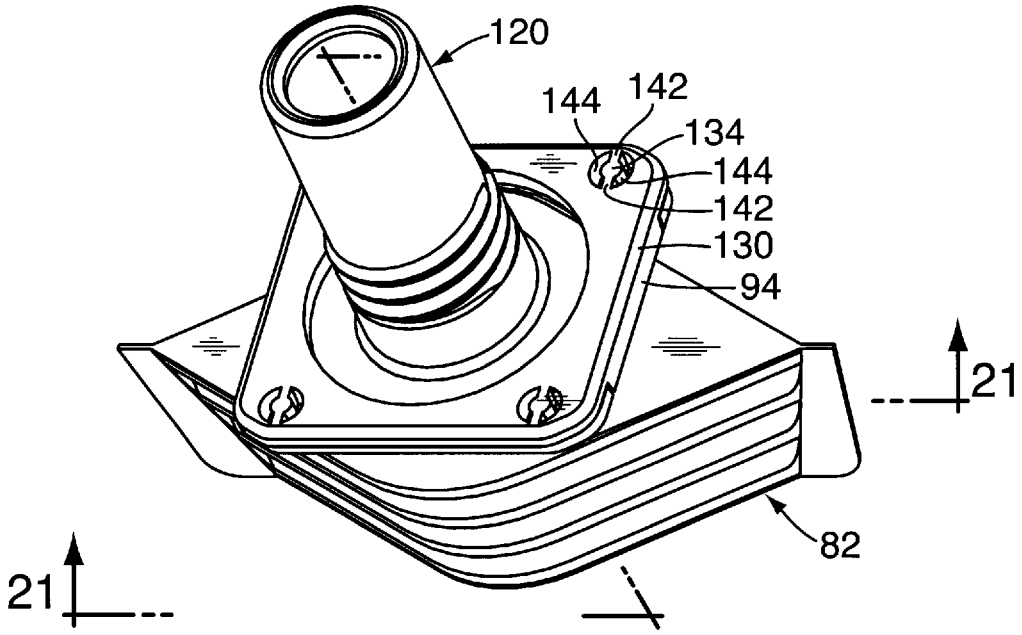
FIG. 20 is a top perspective view of the dispensing structure after the cap has been removed.

The lid structure 80 is preferably molded separately from, and can be subsequently mounted to, the fitment 70. As shown in FIG. 10, the lid structure 80 includes a base 130 for being fixedly and non-releasably attached to the fitment receiver platform 94 as shown in FIGS. 3 and 5. As shown in FIG. 13, features for effecting attachment of the lid structure 80 to the fitment 70 include four posts 134 and two arcuate guide members 138. Each arcuate guide member 138 is adapted to be received in one of the fitment platform arcuate grooves 100 (FIG. 4), and each of the posts 134 is adapted to be received within one of the fitment receiver platform apertures 98 (FIG. 13). As illustrated in FIG. 9, the upper or base end of each post 134 is joined to the upper portion of the lid structure 130 by two support webs or bridges 142 which extend between two generally arcuate openings 144 (FIG. 20).

As illustrated in FIG. 15, each post 134 has an enlarged head 140 located at the post distal end that is wider than one of the apertures 98. The enlarged head 140 defines a slanted surface (as shown in FIG. 15) to accommodate insertion into the aperture 98. Each post 134 with the enlarged head 140 can be forced through a platform aperture 98 owing to temporary elastic deformation of the platform 94 and/or head 140 so that the post 134 can ultimately be received in the aperture 98 with the head 140 located adjacent the bottom side of the receiver platform 94 to retain the fitment 70 and lid structure 80 together in a non-removable, snap-fit engagement.

As illustrated in FIG. 4, the lid structure 80 also includes a tear band 150 extending upwardly from the base 130 to a cap 160. One end of the tear band 160 includes a grippable tab 170.

Figure 7:
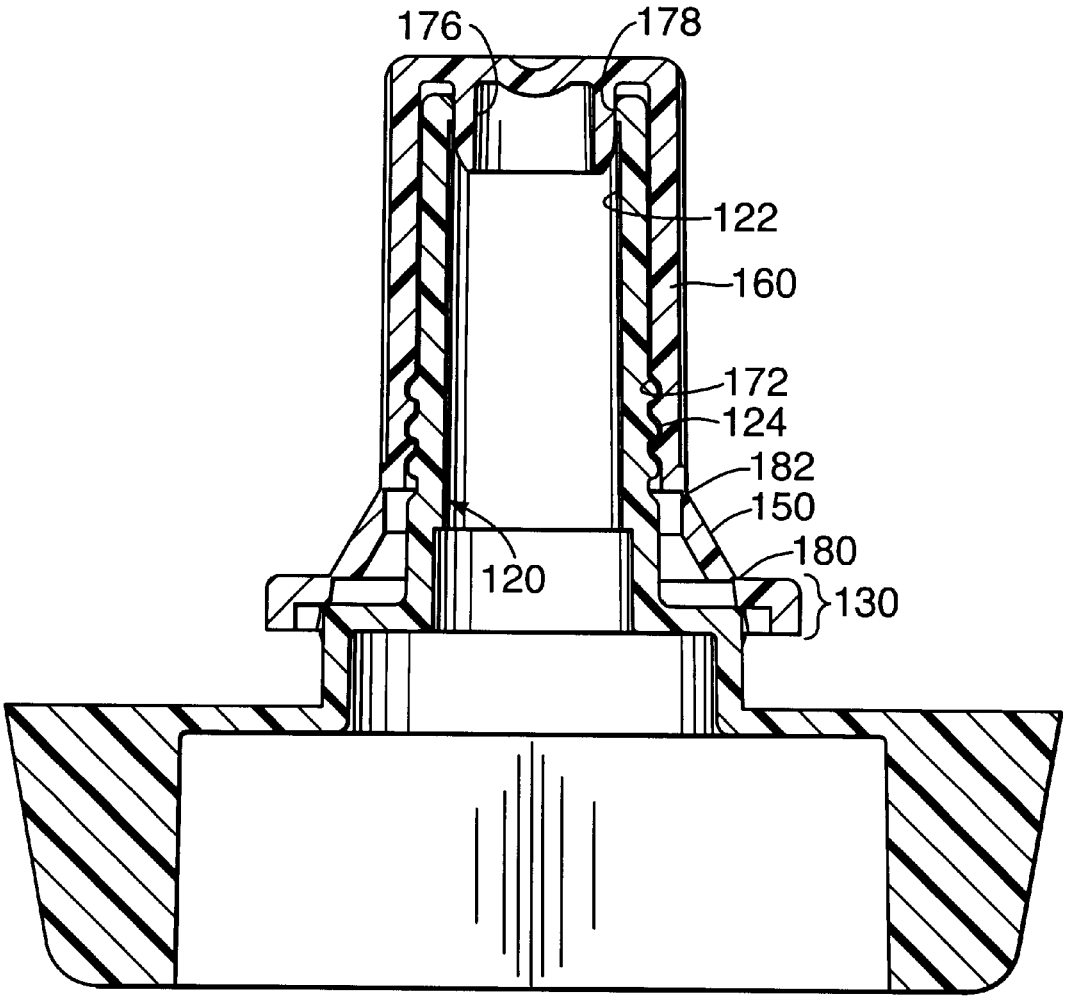
FIG. 7 is a cross-sectional view taken generally along the plane 7—7 in FIG. 6.

With reference to FIG. 12, the cap 160 includes internal, female thread 172 which is adapted to threadingly engage the fitment spout male thread 124 as illustrated in FIG. 7. With reference to FIG. 12, the cap 160 also includes a top wall or upper end wall 174 from which depends a generally annular sealing plug or spud 176 which is adapted to enter the upper, open end of the fitment spout discharge passage 122 as shown in FIG. 7. As shown in FIG. 8, the upper end of the fitment spout 120 defines an inwardly extending seal bead 178 for sealingly engaging the cap spud 176 when the cap 170 is threadingly engaged on the spout 120 (as shown in FIG. 7).

As shown in FIGS. 4 and 7, the lid structure includes at least a first frangible web 180 for initially connecting lower edge of the tear band 150 to the base 130. A second frangible web 182 connects an upper edge of the tear band 150 to the cap 160. Thus, in the preferred embodiment illustrated, the tear band 150 is located between the lid structure base 130 and the lid structure cap 160. The tear band 150 is preferably frustoconical and is defined along its bottom edge by the first frangible web 180 and is defined along its top edge by the second frangible web 182.

In the preferred embodiment, the first frangible web 180 and the second frangible web 182 are each defined by a reduced thickness section of material. Other forms of a frangible web may be used, however. For example, the lower edge of the tear band 150 may be connected to the lid structure base 130 with a circumferential array of connecting tabs or bridges separated apertures, and the frangible connection between the upper edge of the tear band 150 and the lid structure cap 160 may have the same or different construction.

In an alternate embodiment (not illustrated), the tear band 150 may be eliminated altogether, and the cap 160 could be connected with a single frangible web directly to the lid structure base 130. However, it is presently contemplated that the preferred arrangement includes a tear band, such as the tear band 150 which is interposed between the lid structure base 130 and the cap 160.

When the tear band 150 is employed in the lid structure 80, the user may grip the tab 170 projecting upwardly from one end of the tear band 150, and the user may pull on the tab 170 to tear the frangible webs 180 and 182 to separate the cap 160 from the lid structure base 130 and to separate the tamper band 150 partly or completely from the cap 160. The absence of the tear band 150 indicates that the system has been opened or tampered with.

In the preferred embodiment, the tear band 150 is completely separated from the lid structure base 130 but is not completely separated from the cap 160. Preferably, a part of the tear band 150 remains connected to the cap 160 (FIG. 19).

After the tear band 150 has been completely separated from the lid structure base 130, the cap 160 can be unscrewed from the fitment spout 120. However, as shown in FIG. 19, an end portion of the tear band 150 remains connected to the cap 160 so as to avoid creation of a small scrap piece or waste piece which would have to be separately discarded.

Figure 19:
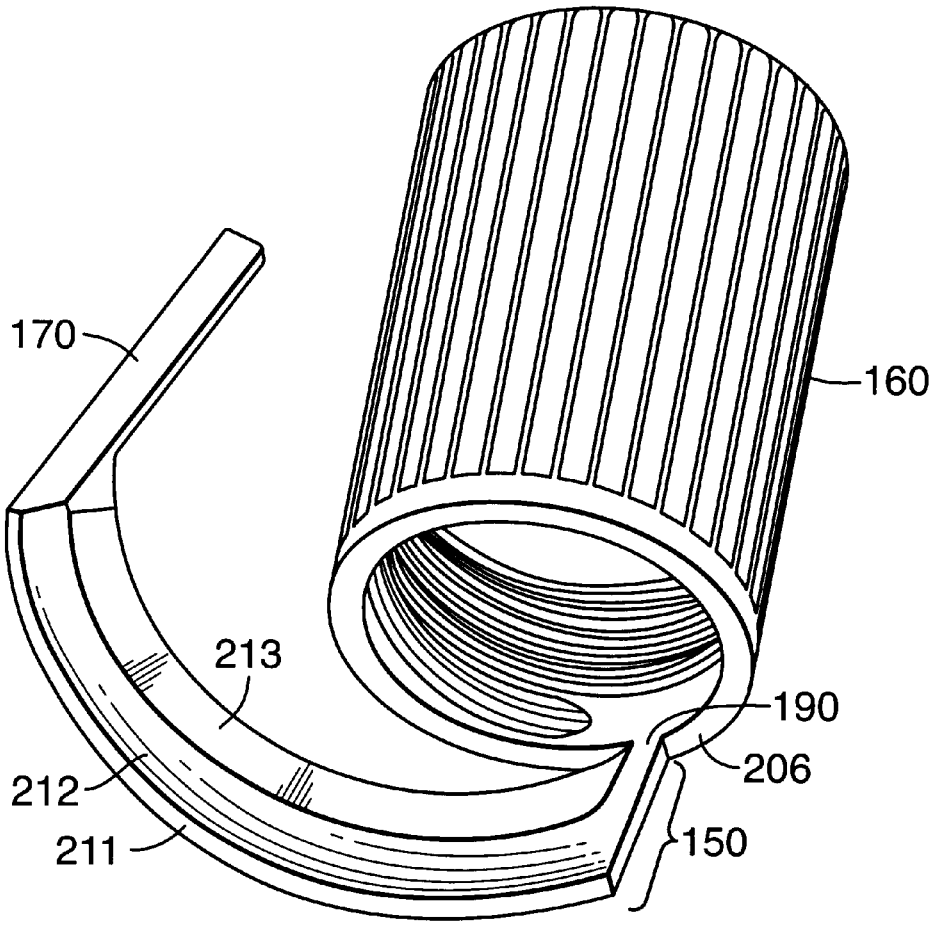
FIG. 19 is a bottom, perspective view of the cap after the tear band has been torn away from the remaining portion of the lid structure and a portion of the cap, and after the cap has been unscrewed from the fitment spout.

As shown in FIG. 19, in the preferred form of the invention, the tear band 150 remains connected to the bottom edge of the cap 160 at an end portion of the tear band 150 where the tear band 150 merges with the cap 160 through an attachment portion or connecting rib 190. The structure of the tear band 150 and connecting rib 190, prior to tearing the tear band 150, is illustrated in FIGS. 9, 11, 16, 17, and 18. FIGS. 9 and 11 show how the tear band 150 and attached grip tab 170 terminate in an opening 202 defined in the lid structure base 130.

The bottom of the structure illustrated in FIG. 11 is shown in an enlarged perspective view in FIG. 16. In FIG. 16 the end of the tear band 150 opposite from the grip tab 170 is shown connected to the bottom of the cap 160 with the connecting portion or rib 190. The bottom of the cap 160 is defined by a generally annular, flat surface 206 which is connected to the tear band 150 along the second frangible web 182. The other peripheral edge of the tear band 150 is attached to the lid structure base 130 with the first frangible web 180. As shown in FIGS. 12 and 16, the inside surface of the tear band 150 includes a lower or first surface 211, an intermediate or second surface 212, and an upper or third surface 213. Adjacent the lower or first frangible web 180, the lid structure base 130 defines a peripheral wall surface 216.

With reference to FIGS. 12 and 16, it can be seen that the tear band 150 is connected through the frangible web 182 to the outside, bottom circumferential edge of the bottom annular surface 206 of the cap 160 except at the end of the tear band 150 where the inner surface of the tear band 150 extends radially inwardly to define the rib 190 connected to the bottom of the cap 160 across the width of the cap bottom annular surface 206.

Figure 21:
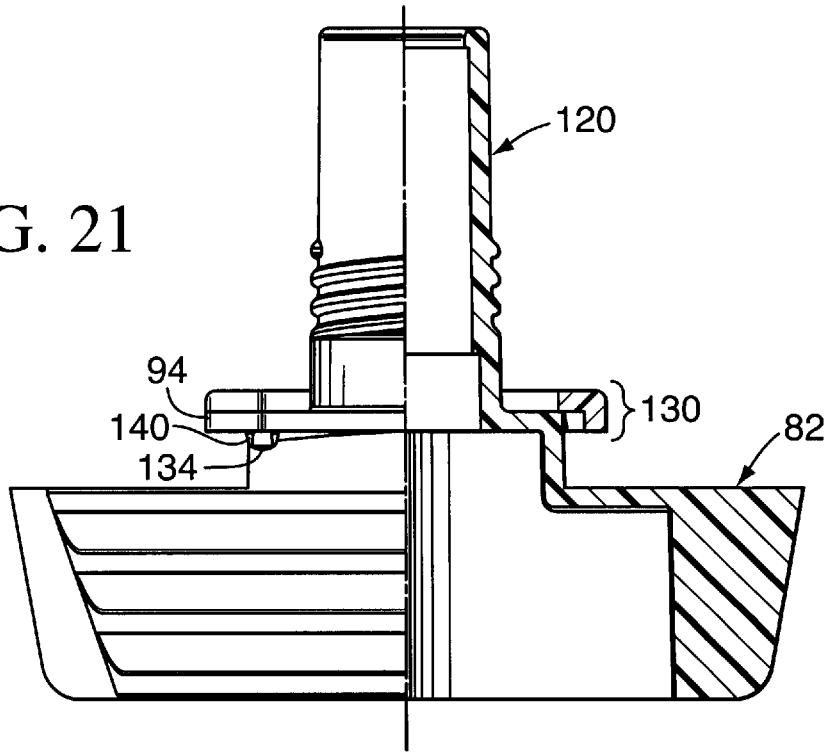
FIG. 21 is a partial cross-sectional view taken generally along the planes 21—21 in FIG. 20.

As shown in FIG. 19, when the tear band 150 is pulled, the frangible web 180 between the tear band 150 and base 130 is torn or severed, and the frangible web 182 connecting the tear band 150 to the cap 160 is also torn or severed, but the tear band 150 remains attached at the rib 190 to the bottom of the cap 160. FIGS. 20 and 21 show the dispensing structure 50 after the tear band 150 and cap 160 have been removed—it being understood that the pouch 60 (FIG. 1) has been omitted from FIGS. 20 and 21 for ease of illustration. It will be appreciated that, as shown in FIGS. 20 and 21, after the cap 160 is removed, the lid structure base 130 still remains securely attached to the fitment receiver 94 by means of the snap-fit engagement effected with the enlarged heads 140 of the posts 134 projecting from the underside of the lid structure base 130 through the fitment receiver 94 as previously explained in detail.

Figure 22:
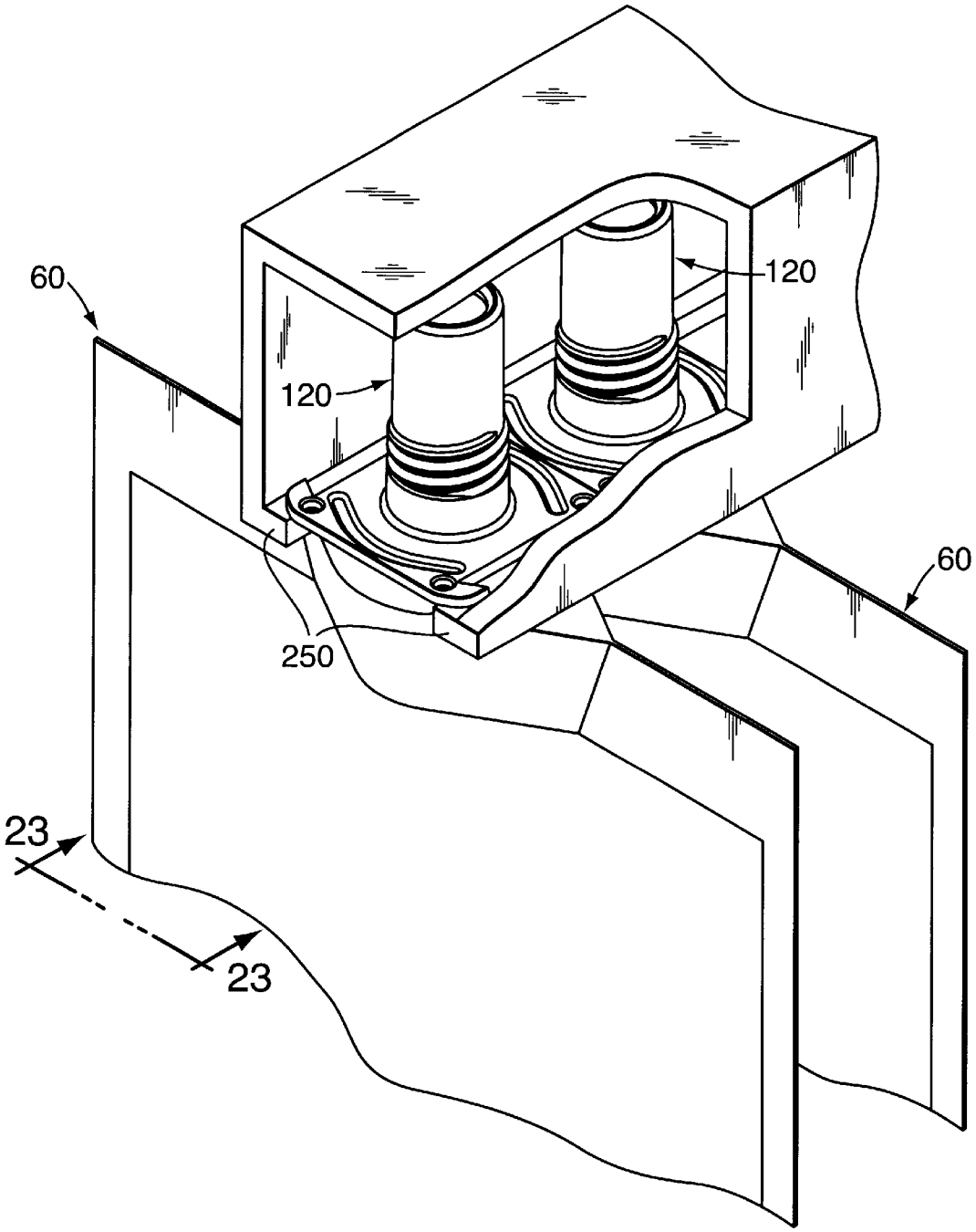
FIG. 22 is a fragmentary, perspective view of two packages that each includes a fitment with the package being supported on a rail system by the fitment for package filling and further processing.
Figure 23:
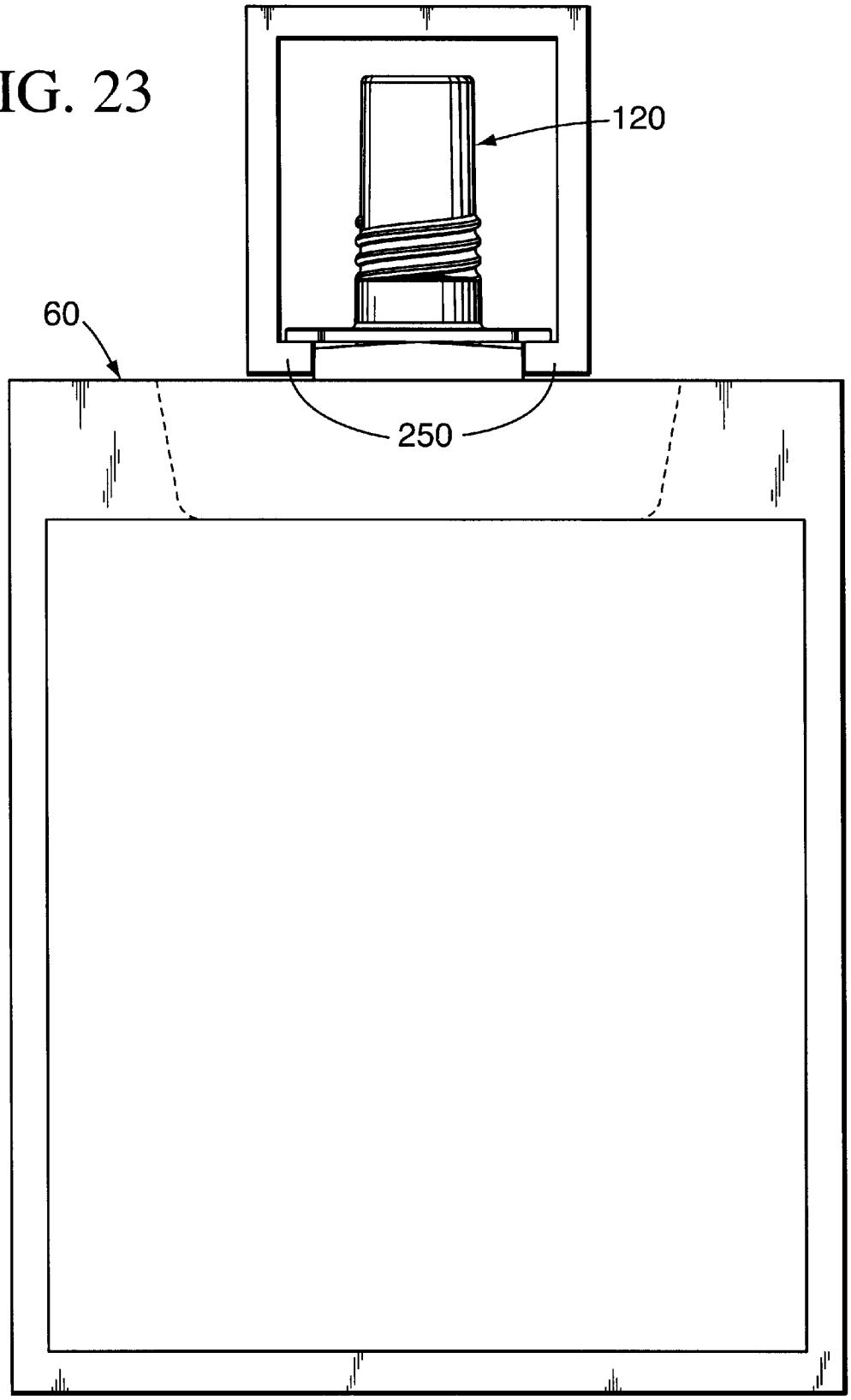
FIG. 23 is an end view of the processing system taken generally along the plane 23—23 in FIG. 22.

FIGS. 22 and 23 illustrate an intermediate stage in one method of manufacturing a package employing the dispensing structure of the present invention. In manufacturing steps prior to the stage illustrated in FIGS. 22 and 23, a dispensing structure fitment 70 and a dispensing structure lid structure 80 as shown in FIG. 4 are separately molded, but not assembled. The fitment 70 is then sealed to the inside opening of an empty pouch 60, and the intermediate assembly can then be supported in a transport system that includes a pair of spaced-apart, parallel rails 250 as shown in FIGS. 22 and 23. Such empty pouch assemblies can be moved along the transport system beneath a filling machine (not illustrated) which inserts a filler tube through the open spout 120 for filling the pouch with product. The detailed structure and operation of such a machine form no part of the present invention. It will be realized, of course, that the pouch could be manually filled with product if desired.

Subsequently, while still supported on rails 250, the assembly, with the pouch now filled with product, can be moved beneath a lid structure installation station (not illustrated) wherein the transport system has an upwardly open region for accommodating automatic installation of the lid structure 80 (FIG. 4) over the spout 120 onto the fitment. Such a lid structure installation station is not illustrated, and the details of the structure and operation of such a station form no part of the present invention. It will be realized, of course, that the lid structure could be manually installed over the spout 120 to the fitment.

In any event, during installation of the lid structure 80, the lid structure 80 (FIG. 4) is pushed downwardly on the spout 120 so that the female threads 172 (FIG. 7) in the cap 160 slide over the spout male threads 124. The cap 160 has enough flexibility and resilience to accommodate such an installation procedure.

As the lid structure 80 is pushed completely downwardly, the lid structure base 130 engages the fitment receiver 94. The guide members 138 of the lid structure are received in the fitment receiver platform grooves 100, and the lid structure base posts 134 (FIG. 13) enter the apertures 98 in the fitment receiver platform 94 so that the enlarged heads 140 of the posts 134 snap below the receiver platform 94 and establish a secure, tight, snap-fit engagement.

The snap-fit engagement does not permit lid structure base 140 to be removed from the fitment receiver platform 94 by the user through conventional, non-destructive means. When the lid structure 80 is thus mounted on the fitment receiver platform 94, a secure, tamper-evident assembly is created. A user must tear away the tear band 150 in order to gain access to the pouch interior.

Even if a tear band 150, per se, is not employed (in an alternate embodiment, not illustrated), and if instead only one, annular frangible web is employed to connect the cap 160 directly to the lid structure base 130, then the user must still break the one frangible web by applying sufficient torque to the cap 160. The destruction of the one frangible web will serve as an indication that the system may have been tampered with or that the cap 160 may have been at least partially unscrewed.

The dispensing structure 50 of the present invention accommodates a variety of other package manufacturing techniques. For example, an empty pouch 60 (FIG. 1), without the dispensing structure 50 initially installed, could be filled with a fluent product. The dispensing structure fitment 70 and lid structure 80 could then be provided as an already assembled, integral closure dispensing structure 50 for being heat-sealed to the top of the open pouch after the pouch has been filled with product.

In another package manufacturing alternative, the dispensing structure 50, including the fitment 70 and the attached, closed lid structure 80, could be initially sealed to an opening in the top of an empty pouch which has an opposite, bottom end left open. The pouch could then be inverted, and the pouch could be filled with product through the open end. Subsequently, the open end of the pouch could be sealed closed by suitable conventional or special techniques, including heat-sealing, adhesive application, etc.

It will be appreciated that when the user removes the cap 160, the spout 120 projects from the fitment substantially free of surrounding structure which might interfere with discharge of the product from the pouch through the spout. Because the cap 160 is completely removable, and because there is no tear band portion which remains attached to the fitment, sufficient clearance exists around the open spout 120 to accommodate pouring the contents from the pouch through the spout as well as to accommodate insertion of the spout into the user's mouth.

If desired, a dispensing valve could be installed in the spout 120. Such a valve may be the same as, or similar to, the valves disclosed in U.S. Pat. No. 5,839,614. Such a valve could also be installed inside the fitment, below the spout, and retained in that position by a suitable snap-fit structure or crimped wall for engaging the flange of the valve. Such a dispensing valve may also be molded directly into the fitment using suitable bi-injection molding techniques which would be especially suitable if the valve is molded from a material, such as silicone, which is different from the material of the fitment.

Although the fitment spout 120 is illustrated as having external, male threads 124 threadingly engaging the cap threads 172 (FIG. 7), other means for releasably mounting the cap 160 on the spout 120 may be employed. For example, the cap spud 176 (FIG. 7) could be altered so that it is much longer and includes an outwardly directed male thread, and then the fitment spout 120 could be provided with a complementary internal, female thread.

In another alternative, the threaded engagement between the cap 160 and spout 120 could be eliminated altogether. Instead, a suitable internal or external, releasable, snap-fit bead and groove arrangement, or bead and bead arrangement, could be employed.

While the preferred embodiment of the dispensing structure 50 is illustrated with four snap-fit posts 134 for securing the lid structure 80 to the fitment 70, it will be appreciated that a greater or lesser number of posts may be employed.

Further, other forms of non-releasable, snap-fit engagement features could be employed instead of the posts and receiving apertures. Although a snap-fit engagement is preferred, in some applications it may be desirable to provide a different means for connecting the lid structure 80 to the fitment 70, such as a thermal bond attachment, ultrasonic weld, adhesive attachment, or the like.

In the preferred embodiment illustrated, the dispensing lid structure 80 includes downwardly depending arcuate walls or ribs 138 for being received in the fitment grooves 100 (FIG. 4). In some applications, these features may be omitted. However, these features when used, can be designed to aid in aligning the lid structure posts 134 with the fitment receiver apertures 98. This can help stabilize the positioning of the lid structure 80 on the fitment 70. This may be advantageous when the completed assembly is opened by the user and twisting actions and torque is applied to the assembly.

With reference to FIGS. 4 and 13, the lid structure preferably also includes a pair of downwardly projecting ribs or walls 280, and these fill the void between the fitment receiving platform wings or tabs 96 to give a smooth and uniform appearance to the completed assembly.

In the preferred embodiment, the tear tab 150 is formed to include a generally frustoconical shape. This allows for simpler molding of the frangible connecting webs and of the grip tab without employing undercuts which would require special and complex molding actions. However, in some applications, where the cost of such complex molding actions can be tolerated, the tear band 150 may have suitable shapes other than generally frustoconical.

It will be readily observed from the foregoing detailed description and from the accompanying illustrations that numerous other variations and modifications may be effected without departing from the true spirit and scope of the novel concepts or principles of this invention.

What is claimed is:

1. A tamper-evident dispensing structure for being sealed to a collapsible pouch having two opposed, flexible web portions sealed to one another so as to define an interior region and so as to define an opening which opens to the interior region and which is adapted to receive a portion of the dispensing structure when the dispensing structure is sealed to the collapsible pouch, said dispensing structure comprising:

(A) a fitment having
- (1) a body for being sealed to said pouch at said opening;
- (2) a receiver on said body;
- (3) a spout extending above said body and receiver; and
- (4) at least one dispensing passage through said body and said spout; and (B) a lid structure that is molded separately from, and that can be subsequently mounted to, said fitment and that has
- (1) a base for being fixedly and non-releasably attached to said fitment receiver;
- (2) a cap for being sealingly and removably mounted on said spout to occlude said dispensing passage;
- (3) a tear band between said cap and said base;
- (4) a first frangible web connecting said tear band to said base for accommodating complete tearing of said tear band from said base; and
- (5) a second frangible web connecting only part of said tear band to said cap to leave said tear band attached to said cap after tearing said second frangible web.

2. The tamper-evident dispensing structure in accordance with claim 1 in which said lid structure base and said fitment receiver are adapted to be snap-fit together.

3. The tamper-evident dispensing structure in accordance with claim 1 in which said tear band has a generally frustoconical configuration.

4. The tamper-evident dispensing structure in accordance with claim 1 in which said first and second frangible webs are each defined by a reduced thickness section of material.

5. The tamper-evident. dispensing structure in accordance with claim 1 in which said tear band includes a grippable tab and an opposite end portion merging with said cap; and said second frangible web extends from said grippable tab to said opposite end portion.

6. The tamper-evident dispensing structure in accordance with claim 1 in which said cap has internal threads.

7. The tamper-evident dispensing structure in accordance with claim 6 in which said fitment has a spout with external threads for threadingly engaging said cap internal threads.

8. The tamper-evident dispensing structure in accordance with claim 1 in which said fitment includes a lower body; and said receiver includes a platform with tabs spaced above, and extending outwardly from, said body for supporting said fitment on rails.

9. The tamper-evident dispensing structure in accordance with claim 8 in which said fitment receiver platform defines at least one aperture extending through said platform; and said lid structure base includes (1) a post, and (2) an enlarged head that (a) is located at the distal end of said post, and (b) is wider than said at least one aperture so that said head can be forced through said platform aperture owing to temporary elastic deformation of at least one of said head and platform whereby said post can be received in said aperture with said head located adjacent said platform to retain said fitment and lid structure in a non-removable snap-fit engagement.

10. A tamper-evident dispensing structure for being sealed to a collapsible pouch having two opposed, flexible web portions sealed to one another so as to define an interior region and so as to define an opening which opens to the interior region and which is adapted to receive a portion of the dispensing structure when the dispensing structure is sealed to the collapsible pouch, said dispensing structure including at least two components comprising:

(A) a fitment having
- (1) at least one surface for being sealed to said pouch around a periphery of said fitment at said opening,
- (2) a receiver, and
- (3) at least one dispensing passage through said fitment; and (B) a lid structure that is molded separately from, and that can be subsequently mounted to, said fitment and that has
- (1) a base for being fixedly and non-releasably attached to said fitment receiver,
- (2) a cap for being sealingly and removably mounted on said fitment to occlude said dispensing passage, and
- (3) at least a first frangible web connecting said cap to said base for accommodating separation of said cap from said base.

11. The tamper-evident dispensing structure in accordance with claim 10 in which said fitment includes (1) a body defining said at least one surface, and (2) a spout extending above said body and receiver to be closed by said cap; and said dispensing passage extends through said body and said spout.

12. The tamper-evident dispensing structure in accordance with claim 10 in which said lid structure and said fitment are initially unassembled.

13. The tamper-evident dispensing structure in accordance with claim 10 further including a tear band between said cap and said base with said first frangible web connecting said tear band to said base, and in which said tear band has a generally frustoconical configuration.

14. The tamper-evident dispensing structure in accordance with claim 10 in which said first frangible web is defined by a reduced thickness section of material.

15. The tamper-evident dispensing structure in accordance with claim 10 in which said lid structure further includes (1) a tear band that (a) is located between said cap and said base, and (b) is defined along one edge by said first frangible web; and (2) a second frangible web connecting only part of said tear band to said cap to leave said tear band attached to said cap after tearing said second frangible web.

16. The tamper-evident dispensing structure in accordance with claim 15 in which said tear band has a generally frustoconical configuration;

said first and second frangible webs are each defined by a reduced thickness section of material;

said tear band includes a grippable tab and an opposite end portion merging with said cap; and said second frangible web extends from said grippable tab to said opposite end portion.

17. The tamper-evident dispensing structure in accordance with claim 10 in which said cap has internal threads, and said fitment has a spout with external threads for threadingly engaging said cap internal threads.

18. The tamper-evident dispensing structure in accordance with claim 10 in which said fitment includes a lower body; and said receiver includes a platform with tabs spaced above, and extending outwardly from, said body for supporting said fitment on rails.

19. The tamper-evident dispensing structure in accordance with claim 18 in which said fitment receiver platform defines at least one aperture extending through said platform; and said lid structure base includes (1) a post, and (2) an enlarged head that (a) is located at the distal end of said post, and (b) is wider than said at least one aperture so that said head can be forced through said platform aperture owing to temporary elastic deformation of at least one of said head and platform whereby said post can be received in said aperture with said head located adjacent said platform to retain said fitment and lid structure in a non-removable snap-fit engagement.

* * * * *